US009380659B2

(12) United States Patent
Radermacher et al.

(10) Patent No.: US 9,380,659 B2
(45) Date of Patent: Jun. 28, 2016

(54) ELECTRICAL DEVICE AND METHOD FOR COMPENSATING AN EFFECT OF AN ELECTRICAL CURRENT OF A LOAD, IN PARTICULAR AN LED UNIT, AND DRIVER DEVICE FOR DRIVING A LOAD, IN PARTICULAR AN LED UNIT

(71) Applicant: KONINKLIJKE PHILIPS N.V., Eindhoven (NL)

(72) Inventors: Harald Josef Günther Radermacher, Aachen (DE); Patrick Alouisius Martina De Bruycker, Nuenen (NL); Dmytro Viktorovych Malyna, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/370,564

(22) PCT Filed: Jan. 2, 2013

(86) PCT No.: PCT/IB2013/050020
§ 371 (c)(1),
(2) Date: Jul. 3, 2014

(87) PCT Pub. No.: WO2013/102853
PCT Pub. Date: Jul. 11, 2013

(65) Prior Publication Data

US 2014/0327371 A1 Nov. 6, 2014

Related U.S. Application Data

(60) Provisional application No. 61/583,707, filed on Jan. 6, 2012.

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0845
See application file for complete search history.

(56) References Cited

U.S. PATENT DOCUMENTS 8,536,799 B1 * 9/2013 Grisamore ..... H05B 33/0848 315/185 R
8,569,972 B2 * 10/2013 Melanson ..... H05B 33/0815 315/247

(Continued)

FOREIGN PATENT DOCUMENTS

WO 2005115058 A1 12/2005
WO 2008029108 A1 3/2008

(Continued)

*Primary Examiner* — Jason M Crawford
*Assistant Examiner* — Kurtis R Bahr

(57) ABSTRACT

Electrical device (30) for compensating an effect of an electrical current ($I_L$) of a load (14; 34), in particular an LED unit having one or more LEDs, when the load is supplied via a phase cut dimmer, which is normally conceived for traditional filament lamps. The electrical device comprising a connection element (66) for electrically connecting the electrical device (30) to an external power source (12) providing a supply voltage (V 10) for powering the load (14;34), a monitoring device (46; 52) for monitoring the electrical current ($I_L$) of the load (14;34) during a first time interval (Toff), and a signal controller (62, 64) connected to the connection element (66) for providing an electrical compensation signal (13) to the connection element (66) during a second time interval ($T_{IR}$, $T_{DC}$) on the basis of the electrical current ($I_L$) monitored by the monitoring device (46; 52).

20 Claims, 6 Drawing Sheets

(56) References Cited

U.S. PATENT DOCUMENTS

| | | | | |
|---|---|---|---|---|
| 8,680,779 | B2 * | 3/2014 | Radermacher | H05B 33/0815 315/291 |
| 8,716,957 | B2 * | 5/2014 | Melanson | H05B 33/0815 315/291 |
| 2007/0182347 | A1 * | 8/2007 | Shteynberg | H05B 33/0815 315/312 |
| 2010/0164406 | A1 * | 7/2010 | Kost | H05B 33/0815 315/307 |
| 2012/0098454 | A1 * | 4/2012 | Grotkowski | H05B 33/0815 315/246 |
| 2015/0256091 | A1 * | 9/2015 | Melanson | H02M 5/293 315/200 R |
| 2015/0351174 | A1 * | 12/2015 | Chen | H05B 33/0896 315/127 |

FOREIGN PATENT DOCUMENTS

| | | | |
|---|---|---|---|
| WO | 2011050453 | A1 | 5/2011 |
| WO | 2011073865 | A1 | 6/2011 |

* cited by examiner

ELECTRICAL DEVICE AND METHOD FOR COMPENSATING AN EFFECT OF AN ELECTRICAL CURRENT OF A LOAD, IN PARTICULAR AN LED UNIT, AND DRIVER DEVICE FOR DRIVING A LOAD, IN PARTICULAR AN LED UNIT

CROSS-REFERENCE TO PRIOR APPLICATIONS

This application is the U.S. National Phase application under 35 U.S.C. §371 of International Application No. PCT/IB13/050020, filed on Jan. 2, 2013, which claims the benefit of U.S. Provisional Patent Application No. 61/583,707, filed on Jan. 6, 2012. These applications are hereby incorporated by reference herein.

FIELD OF THE INVENTION

The present invention relates to an electrical device for compensating an effect of an electrical current of a load and a corresponding method for compensating an effect of an electrical current of a load, in particular an LED unit comprising one or more LEDs. Further, the present invention relates to a driver device for driving a load, in particular an LED unit having one or more LEDs.

BACKGROUND OF THE INVENTION

In the field LED drivers for offline applications such as retrofit lamps, solutions are demanded to cope with high efficiency, high power density, long lifetime, high power factor and low cost, among other relevant features. While practically all existing solutions compromise one or the other requirement, it is essential that the proposed driver circuits properly condition the form of the mains energy into the form required by the LEDs while keeping in compliance with present and future power mains regulations. In addition, it is required that the driver circuits comply with existing power adjusting means, e.g. dimmers or the like, so that the drivers can be used universally as a retrofit driver device including the LED units.

The driver circuits should comply with all kinds of dimmers and especially the drivers should comply with phase-cut dimmers, which are preferably used to regulate the mains power with low power loss. Those dimmers which are usually used to regulate the mains energy provided to a filament lamp need a low load impedance path for a timing circuit operation current to adjust the phase-cut timing. Alternatively to providing this path continuously, making and breaking that path for certain parts of the mains voltage cycle can also result in stable operation. The provision of this low impedance path has to be adjusted with respect to the zero crossing of the mains voltage. Further, to provide a proper timing circuit operation, a high impedance state of the load has to be provided since a load current of an LED unit usually decreased rapidly after a dimmer is switched on. During this high impedance phase a leakage current of the load influences the timing circuit operation and may cause an early switching of the dimmer. In the case that the load of the dimmer consists of multiple retrofit lamp in parallel, each having an individual leakage current, the total leakage current increases accordingly and may cause an unacceptable error of the timing circuit operation, limiting the dimming range.

WO 2011/073865 A1 discloses a driver device for a solid state lamp, wherein a current detector is connected to a rectifying unit and a charge buffer device is incorporated in the driver device. The charge buffer device is provided for generating a suitable drive current and the current detector is provided for driving a current generating unit for adjusting the drive current provided to the lamp.

This driver device is provided for adjusting the drive current as desired for an LED unit, however, this driver device does not prevent an error of the timing circuit caused by a leakage current of the LED unit.

SUMMARY OF THE INVENTION

It is an object of the present invention to provide an electrical device for compensating an effect of an electrical current of a load, a corresponding method for compensating an effect of an electrical current of a load and a driver device for driving a load, in particular an LED unit comprising one or more LEDs, providing compatibility of a dimmable load to different power supply units, in particular to phase-cut dimmers, to ensure a proper operation of the power supply unit with low technical effort.

According to one aspect of the present invention, an electrical device is provided for compensating an effect of an electrical current of a load, in particular an LED unit having one or more LEDs, comprising:

- a connection element for electrically connecting the electrical device to an external power source providing a supply voltage for powering the load,
- a monitoring device for monitoring the electrical current of the load during a first time interval, and
- a signal controller connected to the connection element for providing an electrical compensation signal to the connection element during a second time interval on the basis of the electrical current monitored by the monitoring device.

According to another aspect of the present invention, a driver device is provided for driving a load, in particular an LED unit having one or more LEDs, comprising:

- input terminals for receiving an input voltage from an external power source,
- output terminals for providing a load current for powering the load,
- a monitoring device connected to at least one of the input or output terminals for monitoring an electrical current during a first time interval, and
- a signal controller connected to at least one of the input terminals or the output terminals for providing an electrical compensation signal to at least one of the input terminals or the output terminals during a second time interval on the basis of the electrical current monitored by the monitoring device.

According to still another aspect of the present invention a method is provided for compensating an effect of an electrical current of a load, in particular an LED unit comprising one or more LEDs, the method comprising the steps of:

- connecting an electrical device to an electrical power supply by means of a connection element,
- monitoring the electrical current during a first time interval, and
- providing an electrical compensation signal to the connection element during a second time interval on the basis of the electrical current monitored during the first time interval.

According to the invention, the monitoring device detects the electrical current or receives data corresponding to the electrical current or is provided to get the information regarding the electrical current in general in a different way.

Preferred embodiments of the invention are defined in the dependent claims. It shall be understood that the claimed method has similar and/or identical preferred embodiments as the claimed device and as defined in the dependent claims.

The present invention is based on the idea to provide an electrical device as an add-on device connectable to a power source and a dimmable load to provide compatibility of the load and the power supply including a dimmer device and to ensure the proper operation of the timing circuit of the dimmer device. To achieve the proper operation of the timing circuit, the electrical device controls the operation of the timing circuit by providing an electrical signal that influences the operation accordingly. Since an error of the timing circuit is usually caused by an electrical current, e.g. a leakage current occurring during a first time interval of a duty cycle of the supply voltage and causes an error after this time interval, the electrical current forming the root cause of the error of the timing circuit is monitored during the first time interval and the correction signal is provided during a second time interval to compensate the error. Hence, an error of the timing circuit of the power source or a connected dimmer can be corrected with low technical effort and the compatibility of the load to the dimmer device can be achieved.

Alternatively to full correction of the error, the error may be stabilized to a fixed value, such that it is only perceived as an offset in the control characteristics of the system, but does not change e.g. with different number of lamps per dimmer or from installation to installation.

According to a preferred embodiment, the electrical current is a leakage current of the load. This is a possibility to monitor the electrical parameter having the largest influence on the dimmer device operation.

According to a further preferred embodiment, the monitoring device comprises a measuring device for measuring the electrical current or a receiver for receiving a signal corresponding to the electrical current. This provides a simple solution to detect the electrical current or receive a corresponding signal with low technical effort.

In a preferred embodiment, the compensation signal is a charge current exchanged between the power supply and the electrical device to compensate the effect caused by the leakage current. This provides a simple solution to adjust a voltage of a timing capacitor of the dimmer timing circuit and to correct the error of the timing circuit caused by the leakage current.

In a preferred embodiment, the compensation signal is a voltage provided in series with the load. This is a simple solution to drive an additional current to charge or discharge the timing capacitor of the timing circuit to correct the error caused by the leakage current.

In a preferred embodiment, the signal controller comprises an impedance path forming a defined current path for providing the charge current during the second time interval. This is a simple solution to charge or discharge the timing capacitor of the timing circuit and to reduce the voltage at the timing capacitor caused by the leakage current.

According to a preferred embodiment, the signal controller comprises a resistor for changing a resistance of the impedance path to control the charge current during the second time interval. This is a simple solution to adjust the electrical charge of the timing capacitor of the timing circuit to a desired level to control the timing of the timing circuit by means of the electrical device.

According to a further embodiment, the signal controller is adapted to decrease the resistance of the impedance path continuously or stepwise during the second time interval. Hence, the charge stored in the timing capacitor can be adjusted precisely with low technical effort.

According to a further embodiment, the second time interval is adjusted to a zero crossing of the supply voltage such that the current path is provided before and after the zero crossing of the supply voltage. This is a simple possibility to adjust the voltage of the timing capacitor to a predefined level with low technical effort.

In a further preferred embodiment, a transition from the first to the second time interval is adjusted close to the zero crossing of the supply voltage, and preferably provided within a time frame of 2 ms around the zero crossing. This provides a further degree of freedom to adjust the accumulated charge of the timing capacitor.

According to a further preferred embodiment, the signal controller comprises a capacitor for providing the charge current during the second time interval, wherein the monitoring device is adapted to charge the capacitor during the first time interval. This is a simple and self-adjusting possibility to monitor the leakage current, to store the respective charge in the capacitor and to provide the stored charge during the second time to correct the error of the timing capacitor caused by the leakage current. Further, this is a simple solution to detect the leakage current individually independent of the attached load and to adjust the charge and the voltage of the timing capacitor accordingly.

In a preferred embodiment of the driver device, the driver device comprises a first current path and a second current path, wherein the first and the second current path form a part of a rectifier unit, wherein the first current path and second current path each comprises a monitoring device and a signal controller, wherein the monitoring devices are provided for monitoring the electrical current in the respective current path and the signal controller are provided for providing the electrical compensation signal. This is a simple solution to integrate the monitoring device and the signal controller in the driver device with low technical effort, since the respective current paths are provided for unipolar operation.

In a further preferred embodiment of the driver device at least one of the input terminals is connected to a voltage converter unit which is connected to the external power source, wherein the voltage converter includes a timing capacitor, and wherein the compensation signal is a charge current which is provided to the voltage converter to at least partially charge or discharge the timing capacitor. This provides an effective solution to adjust the error of the timing capacitor caused by the leakage current of the dimmable load.

As mentioned above, the present invention provides a simple and effective solution to adapt a dimmable load, in particular an LED unit comprising one or more LEDs, to a power source and to ensure the compatibility of the load to the power source including a dimmer device, wherein a timing circuit operation is not affected by the connected load and operates as desired. This is achieved by measuring an electrical signal, in particular a leakage current of the load and by providing a compensation signal, preferably a current exchanged with the dimmer device to compensate a charge which is accumulated in a timing capacitor of the timing circuit due to the leakage current of the load. Hence, a proper operation of the dimmer device can be achieved with low technical effort and can be integrated as a retrofit element to an existing power source including a dimmer device and, further, to an already existing dimmable load, in particular an LED unit.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
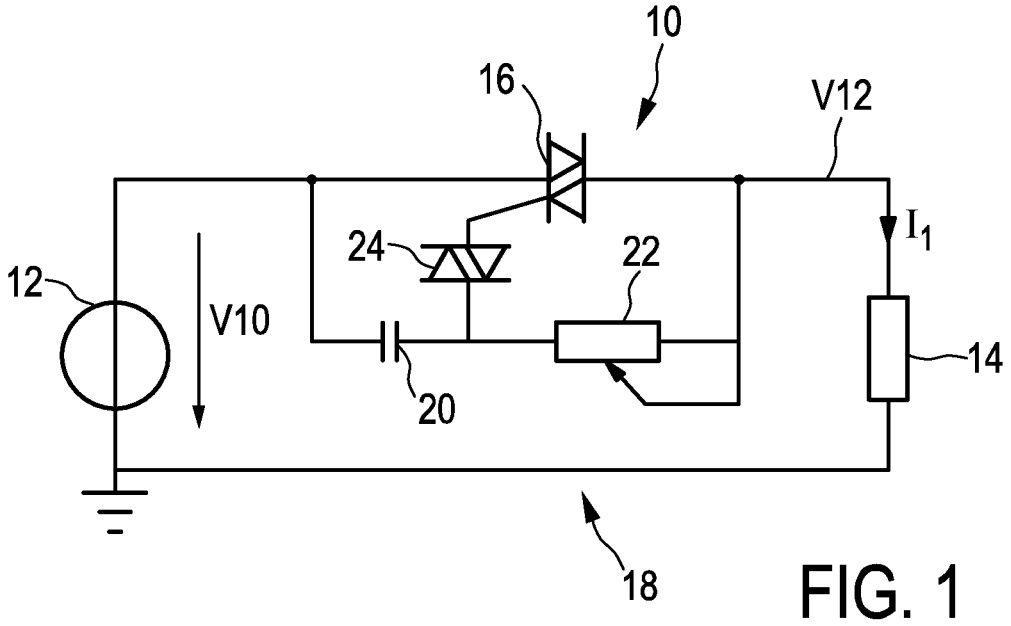
FIG. 1 shows a schematic block diagram of a known dimmer device connected to an incandescent lamp.

FIG. 1 shows a schematic block diagram of a dimmer device generally denoted by 10. The dimmer device 10 is connected to an external voltage supply 12, which is preferably mains, which provides a supply voltage V10. The dimmer device 10 provides a modified input voltage V12 having a leading edge phase-cut and a load current I1 to a load 14. The load 14 may be an incandescent bulb lamp.

The dimmer device 10 comprises a triac 16 for connecting the external voltage supply 12 to the load 14. Parallel to the triac a timing circuit 18 is connected. The timing circuit 18 comprises a timing capacitor 20, a variable resistor 22 and a diac 24, which is connected to the triac 16. The voltage of the timing capacitor 20 is provided to the diac 24 which switches the triac 16. When the charge of the timing capacitor 20 reaches a predefined level, the diac 24 is switched off and the supply voltage V10 is provided to the load 14. When the triac 16 is switched off, the supply voltage V10 is provided to the timing circuit 18. Hence, the timing capacitor 20 of the timing circuit 18 is charged up to a predefined voltage level, which switches the diac. As soon as the predefined voltage is reached, the triac 16 is switched on again and the timing capacitor 20 is discharged to a forward voltage of the diac 24.

During a phase when the triac 16 is switched on, the voltage across the timer circuit 18 is close to zero and the timing capacitor 20 is not charged. The triac 16 connects the external voltage supply 12 to the load 14 until the current through the triac 16 and thus the load current I1 is above a hold current of the triac 16. Then the triac is switched off and the charging of the timing capacitor 20 starts again.

If the load 14 is an high power incandescent bulb lamp, the triac 16 keeps conducting until or just before the zero crossing of the input voltage V10. The impedance of the load 14 is low enough to ensure a high enough load current I1 to ensure the conduction of the triac 16 up to the zero crossing.

If the load 14 is an LED unit a normal operation comparable to the operation with an incandescent bulb (incandescent-like operation) can be assured only if the triac current, i.e. the load current I1 is larger than the hold current of the triac 16. This can be achieved only for corresponding power levels (e.g. 40 W) having a respective load current I1. Most of the SSL retrofit lamps are operated below that level. Hence, it is inevitable to switch the triac 16 off before the zero crossing as described below.

Figure 2:
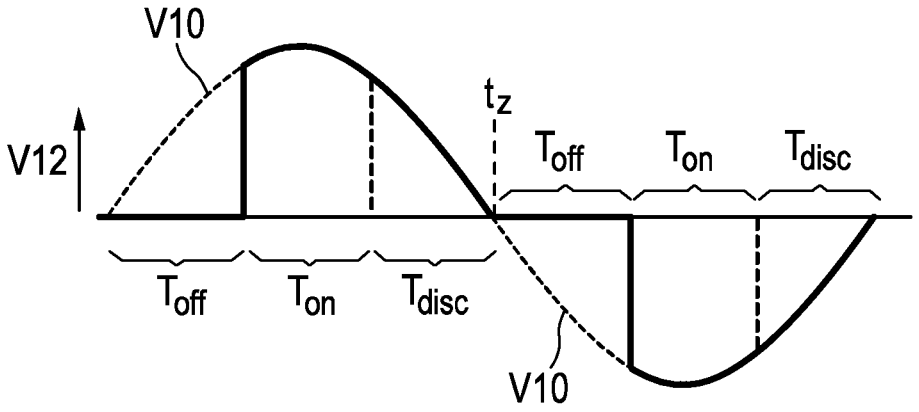
FIG. 2 shows a diagram illustrating the voltage supplied by the dimmer device.

In FIG. 2, a diagram of the input voltage V12 provided by the dimmer device 10 is schematically shown. Each half cycle of the supply voltage V10 (dashed line) comprises three different phases. The first phase, the off-phase $T_{off}$, when the triac 16 is switched off and the input voltage V12 is zero. The second phase is the on phase $T_{on}$ following the off-phase $T_{off}$, when the triac 16 is conducting and the input voltage V12 (solid line) is basically identical with the supply voltage V10. After the on phase $T_{on}$, a disconnection-phase $T_{disc}$ is provided wherein the triac 16 is switched off. During this disconnection-phase $T_{disc}$, the load impedance should be increased to avoid a charging of the timing capacitor 20 and to avoid an early switching of the diac 16. During this disconnection-phase $T_{disc}$, the impedance of the load 14 should be larger than the impedance of the timer circuit 18. Preferably, the impedance of the load 14 during the disconnection-phase $T_{disc}$ should be at least 2 MOhm. After a zero crossing $t_z$, the off-phase $T_{off}$ of the following half cycle of the supply voltage V10 begins. During this off-phase $T_{off}$, the impedance of the load 14 should be low to charge the timing capacitor 20 comparable to normal operation. Hence, the impedance of the load 14 has to be switched from the high impedance state to a low impedance state precisely at the zero crossing $t_z$ of the supply voltage V10.

During the disconnection-phase $T_{disc}$ an open circuit should be connected to the dimmer device 10, however, since the connected load 14 has to monitor the input voltage V12 in order to switch to the low impedance state during $T_{off}$, a measurement circuit may be used across the input terminals of the load 14. This measurement circuit will have an input current, referred here to as leakage current during the disconnection-phase $T_{disc}$. This leakage current is also provided to the dimmer device 10 and charges the timing capacitor 20. When the next off-phase $T_{off}$ starts and the low impedance path is connected to the dimmer device 10, the timing capacitor 20 comprises a not desired electrical charge or, in other words, the timing capacitor 20 is precharged. Hence, the charge of the timing capacitor 20 reaches the predefined voltage which switches the diac 24 at a different point in time during the following off-phase $T_{off}$. An undesired altering of the switching time of the triac 16 results from the leakage current during the disconnection-phase $T_{disc}$. In the case that one load 14 is connected to the dimmer device 10, the altering of the switching point is usually small, however, if a plurality of loads 14 are connected in parallel to the dimmer device 10, the switching point of the dimmer device 10 is strongly affected.

Figure 3:
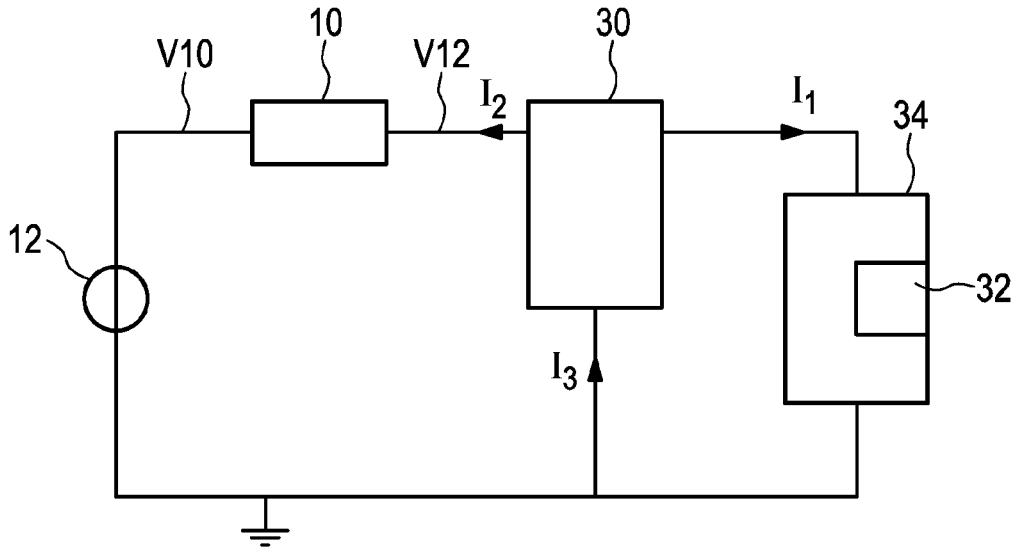
FIG. 3 shows a schematic block diagram of a first embodiment of the electrical device connected to an external power source and to a dimmable load.

In FIG. 3 an embodiment of an electrical device is schematically shown and generally denoted by 30. The electrical device 30 is schematically shown integrated in an electrical circuit. The electrical device 30 is connected to the dimmer device 10 and receives the input voltage V12 from the dimmer device 10. The external voltage supply 12 provides the supply voltage V10 to the dimmer device 10. The electrical device 30 is also directly connected to the external voltage supply 12 or connected to neutral. The electrical device 30 is connected to a load 34 which is formed of a driver device for driving an LED 32. The load current I1 is provided from the dimmer device 10 through the electrical device 30 to the load 34 and the driver device provides a drive current to the LED 32. The drive current may be different from the load current I1. The load 34 is also connected to the external voltage supply 12 or to neutral. A current I2 is exchanged with the dimmer device 10. The electrical device 30 adds a compensation current I3 (of potentially variable amplitude and polarity) to the current I2, which is exchanged with the dimmer device 10 during certain time intervals to compensate a leakage current of the load 34 in at least one different point in time as described below.

As mentioned above, during the disconnection-phase $T_{disc}$ the load 34 has a leakage current which is also provided to the dimmer device 10 and charges a timing capacitor 20. To compensate the leakage current, the electrical device 30 provides a compensation current I3 in addition to the current I2 to the dimmer device 10 during the off-phase $T_{off}$ or after the disconnection-phase $T_{disc}$ has been terminated.

To provide the compensation current I3, the electrical device 30 measures the leakage current during the disconnection-phase $T_{disc}$ and provides the compensation current I3 after the disconnection-phase $T_{disc}$.

Figure 4:
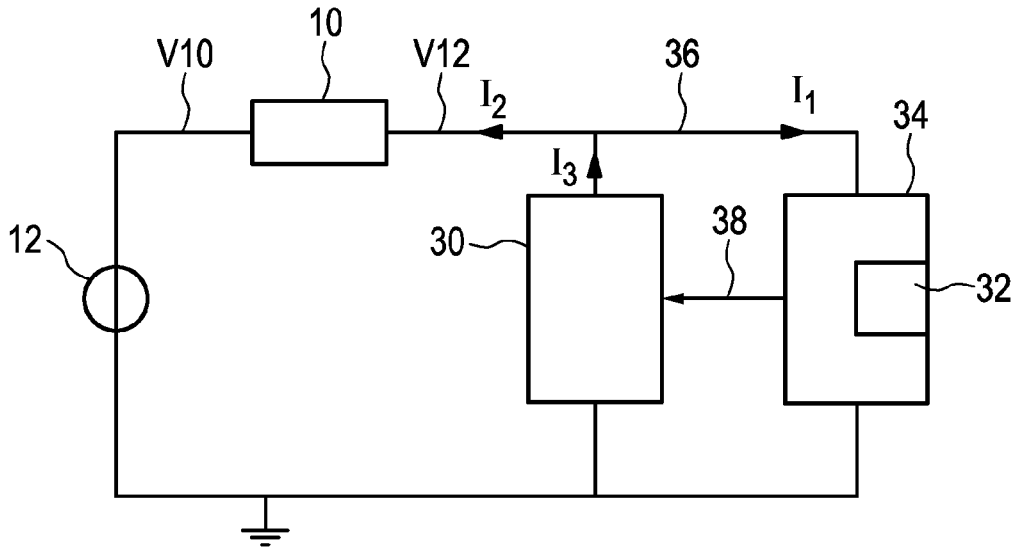
FIG. 4 shows a second embodiment of the electrical device connected to an external power source and to a dimmable load.

In FIG. 4 an alternative embodiment of the electrical device 30 is schematically shown and integrated in an electrical circuit. The electrical device 30 is connected to an electrical connection 36 connecting the dimmer device 10 to the driver device 34. The load 34 is connected to the external power supply 12 or to a neutral. Since the electrical device 30 needs the value of the leakage current (by monitoring, evaluating, estimating, etc) occurring during the disconnection-phase $T_{disc}$ the electrical device 30 is also connected to the load 34 and receives an electrical signal 38 corresponding to the leakage current during the disconnection-phase $T_{disc}$. On the basis of the received leakage current information, the electrical device 30 exchanges the compensation current I3 with the dimmer device 10 after the disconnection-phase $T_{disc}$ has been terminated to compensate the leakage current.

The measurement of the leakage current and the exchange of the compensation current I2 with the dimmer device 10 is provided in different ways as described in the following.

Figure 5:
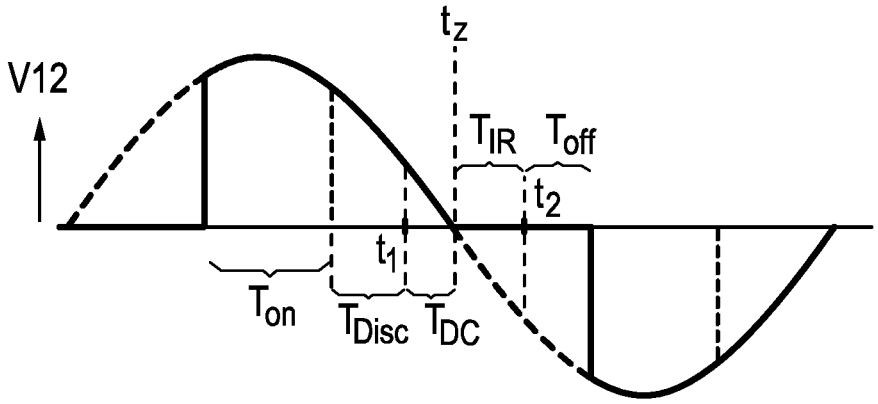
FIG. 5 shows a timing diagram of the voltage provided by the dimmer device to explain the function of the electrical device.

FIG. 5 shows a timing diagram of the input voltage V12 provided by the dimmer device 10 for explaining the function of the electrical device 30 synchronized to the input voltage V12.

As described above, the zero crossing $t_z$ of the supply voltage V10 is detected by the electrical device 30 and the electrical device 30 switches from the high impedance disconnection-phase $T_{disc}$ to a low impedance state, the off-state $T_{off}$ to start the charging of the timing capacitor 20. Since the residual voltage in the capacitor 20 has a different polarity than the final charging stage during the following charging period, initially the voltage across the timing capacitor 20 decreases. This is the intended operation. As mentioned above, the leakage current during the disconnection-phase $T_{disc}$ increases the voltage across a timing capacitor 20, so that the charging into the one direction starts at a too high level and will hence take longer than without the leakage current. To compensate the charge accumulated in the timing capacitor 20 by the leakage current, the electrical device 30 switches from the high impedance state to the low impedance state at $t_1$ slightly before the detected zero crossing $t_z$. Since the input voltage V12 at $t_1$ is lower than the voltage across the timing capacitor 20, the timing capacitor 20 can be discharged earlier during a time interval $T_{DC}$ and the decrease of the timing capacitor voltage starts earlier so that the error due to the leakage current can be compensated. The electrical device 30 determines the switching point $t_1$ dependent on the measured leakage current to compensate the effect of the leakage current accordingly. Since the possible shift of the switching point $t_1$ is limited due to the relation of the value of the supply voltage V10 to the value of the (residual) voltage in the timing capacitor 20, this compensation method is preferably used for single lamp systems which have a low leakage current.

Further, an intermediate resistance state can be introduced to stabilize an error to due to the leakage current. After detection of the zero crossing $t_z$ the electrical device 30 switches to an intermediate resistance state by means of an intermediate resistance path during a time interval $T_{IR}$. Hence, the charging of the timing capacitor 20 is reduced compared to the original low impedance state $T_{off}$. After the intermediate resistance state interval $T_{IR}$ the electrical device 30 switches to the low impedance state during the off-phase $T_{off}$. This will delay the switching point of the dimmer device 10. However, this delay is fully under control of the electrical device 30, so the switching time when the triac 16 is switched on can be determined by the point in time $t_z$ when the resistance is switched from the intermediate resistance state $T_{IR}$ to the low impedance state $T_{off}$. Hence, the switching point of the dimmer device is slightly delayed due to the slower charging of the timing capacitor 20, however, the delay of the switching point of the dimmer device 10 can be determined by the electrical device 30 by determining the switching point $t_2$ switching from intermediate resistance state $T_{IR}$ to the low impedance state $T_{off}$.

Accordingly, the electrical device 30 detects that load current I1 delivered from the dimmer device 10. On the basis of the measured load current I1 and the measured leakage current, the electrical device 30 can estimate the number of connected parallel load 14 (e.g. lamps) and shift the switching point $t_2$ closer to the zero crossing to compensate the shift of the switching point of the dimmer device 10 accordingly.

According to a preferred embodiment, the resistance of the intermediate resistance path of the electrical device 30 is decreased continuously during the intermediate resistance state interval $T_{IR}$ e.g. by a programmable, voltage controlled current sink.

According to another embodiment, a capacitor is connected to the input terminal of the electrical device 30 during the disconnection-phase $T_{disc}$. Any current through the dimmer device 10 during the disconnection-phase $T_{disc}$ will flow through the timing capacitor 20 and will charge the timing capacitor 20 accordingly. This leakage current will also flow through the electrical device 30 and will at least partially charge the capacitor accordingly. In other words, the charge which is accumulated in the capacitor of the electrical device 30 during the disconnection-phase $T_{disc}$ is related to the charge in the timing capacitor 20. During the off-phase $T_{off}$ after the zero crossing $t_z$ the charge accumulated by the capacitor of the electrical device 30 will be provided as the compensation current I3 to the dimmer device 10 and will compensate the charge accumulated in the timing capacitor 20 at least partially. Hence, the leakage current can be measured for each connected lamp and the compensation current I2 can be provided to the dimmer device 10 accordingly. Hence, no separate measurement of the leakage current is necessary. The main benefit of this method is that multiple connected lamps are supported and the compensation current I3 is adapted to the leakage current accordingly.

Figure 6:
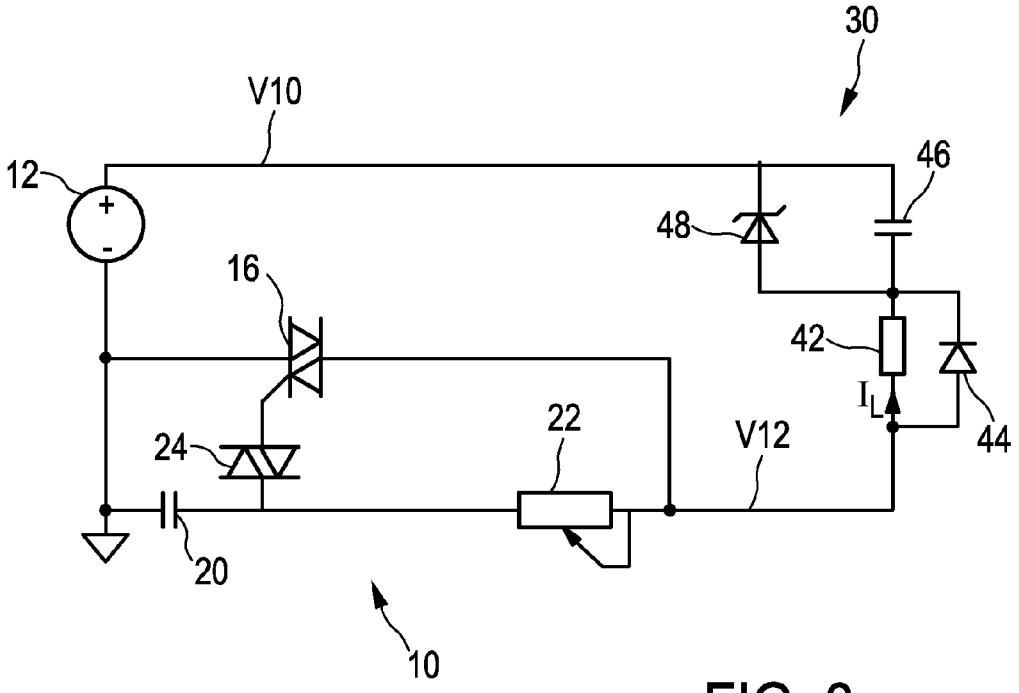
FIG. 6 shows a schematic equivalent circuit diagram of one embodiment of the present invention.

FIG. 6 shows a schematic diagram of one embodiment of the electrical device 30 simplified to single polarity operation during the disconnection phase $T_{disc}$. The dimmer device 10 is connected to neutral and to the external power supply 12 and the electrical device 30 is connected to the dimmer device 10 and to the external voltage supply 12. In FIG. 6 the load 34 is not shown. The electrical device 30 comprises a sensing resistor 42 for sensing the input voltage V12 connected in parallel to a diode 44 for simulating the switching from the disconnection-phase $T_{disc}$ to the off-phase $T_{off}$. The sensing resistor 42 also represents the components of the electrical device 30 and the load 34 which cause the leakage current $I_L$. In series to the sensing resistor 42 and the diode 44 a parallel connection of a capacitor 46 and a Zener diode 48 is provided. The capacitor 46 is charged by the leakage current $I_L$ during the disconnection-phase $T_{disc}$. During the off-phase (not shown), the charge accumulated in the capacitor 46 is released and provided to the dimmer device 10. The benefit of the circuit shown in FIG. 6 is that no separate measurement is necessary and the charge accumulated in the capacitor 64 is provided to the dimmer device 10 accordingly. The leakage current IL leads to the undesired charging of the timing capacitor 20. When the capacitor 46 is discharged during the off-phase $T_{off}$, the voltage across the timing capacitor 20 is reduced to the usual starting point of the charging procedure during the low impedance state $T_{off}$. The capacitor 46 preferable has a capacity of 10 nF. The sensing resistor 42, so the equivalent input impedance of the load 34 may have a resistance of 2 MOhm.

Figure 7:
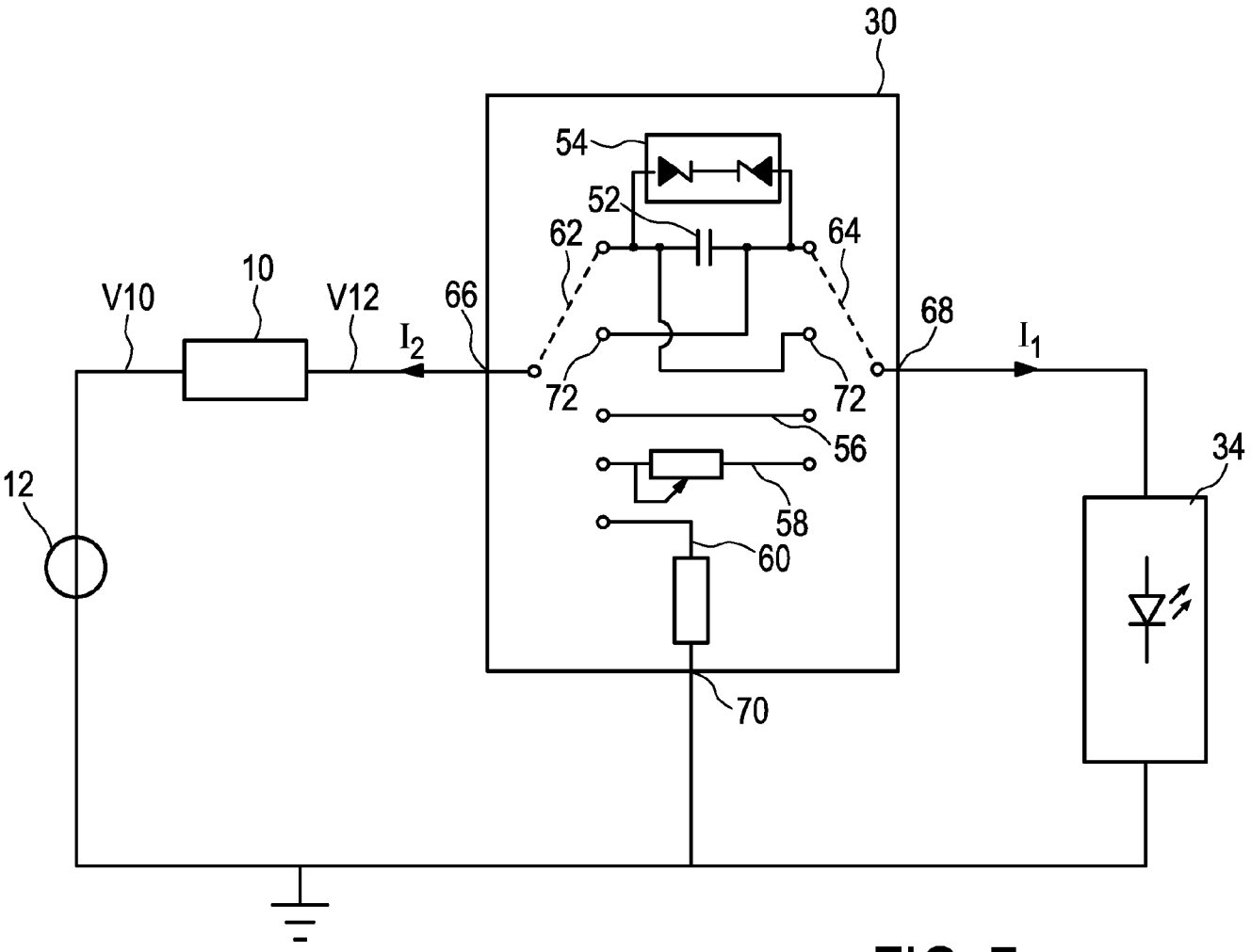
FIG. 7 shows a detailed schematic block diagram of the electrical device of FIG. 3.

In FIG. 7 an embodiment of the electrical device 30 is schematically shown for bipolar operation. The electrical device 30 is connected to the dimmer device 10, to the load 34 and to neutral. The electrical device 30 comprises a capacitor 52 and a protection device 54 connected in parallel to the capacitor 52. The electrical device 30 further comprises a low resistance path 56, a variable resistance path 58 and a resistance path 60. The electrical device 30 further comprises a first and a second switching element 62, 64 for connecting the components 54-60 of the electrical device 30 to an input terminal 66 and to output terminals 68, 70 of the electrical device 30. The switching elements 62, 64 are preferably formed of semiconductor devices. To realize the different states during the intervals $T_{on}$, $T_{disc}$, $T_{off}$, and $T_{DC}$ the switching devices 62, 64 connects the low resistance path 56, the variable resistance path 58 and/or the resistance path 60 to the input terminal 66 and one of the output terminals 68, 70. For measuring the leakage current IL, the capacitor 52 can be connected to the input terminal 66 and the output terminal 68 in a first switching position to charge the capacitor 52 during the disconnection-phase $T_{disc}$ and after the zero crossing $t_z$, the polarity of the capacitor 52 is inverted by means of a second switch position 72 to provide the collected charge as the compensation current $I_2$ to the dimmer device 10.

Hence, the different states described above can be provided by the electrical device 30 shown in FIG. 6 to compensate the effect of the leakage current $I_L$ in order to operate the dimmer device 10 as desired.

Figure 8:
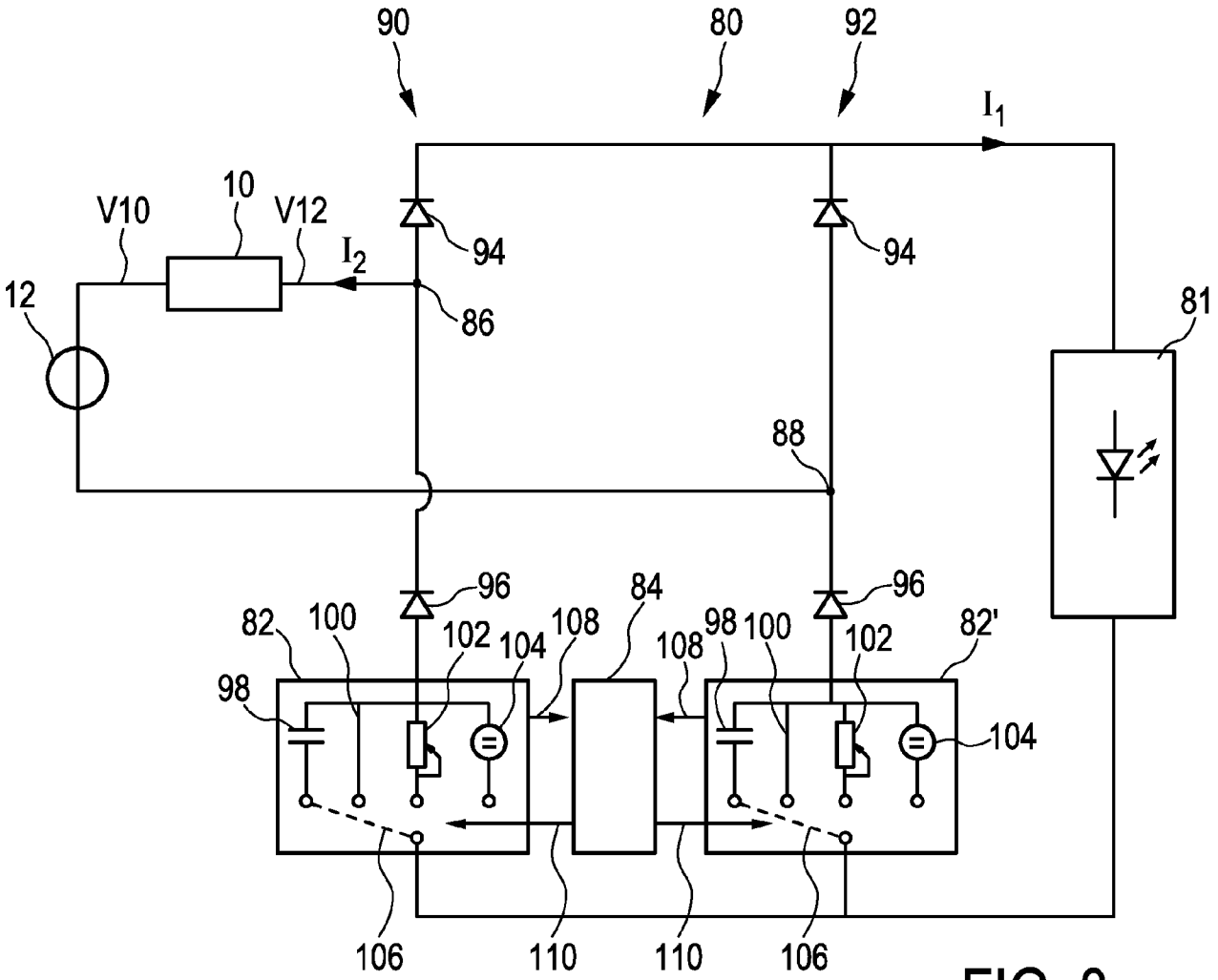
FIG. 8 shows a detailed schematic block diagram of a driver device connected to an external power source for driving a dimmable load.

In FIG. 8 a driver device 80 for driving a load 81 is schematically shown. The driver device 80 comprises two electrical devices 82, 82' and a control unit 84 for controlling the electrical devices 82, 82'.

The driver device 80 comprises two input terminals 86, 88 connecting the driver device 80 to the voltage supply 12 and to the dimmer device 10. The driver device 80 comprises two current paths 90, 92, each comprising two diodes 94, 96 forming a rectifier unit. The electrical devices 82, 82' are each incorporated in one of the current paths 90, 92 for measuring the leakage current $I_L$ in the respective path 90, 92 and for providing the compensation current $I_3$. The electrical devices 82, 82' each comprises a capacitor 98 a low resistance path 100, a variable resistance path 102 and a current source 104. The electrical devices 82, 82' each comprises a switching device 106 for connecting the components 98-104 to the respective current path 90, 92. The control unit 84 is connected to each of the electrical devices 82, 82' and receives a measurement signal 108 from each of the electrical devices 82, 82'. Dependent on the measurement signal 108, the control unit 84 controls the switching devices 106 by means of a control signal 110 to connect the different components 98-104 to the respective current path 90, 92 to provide the compensation current $I_2$ to the dimmer device 10. Hence, for each of the current path 90, 92 a unipolar operating electrical device 82, 82' can be provided to measure a leakage current IL in the respective current path 90, 92 and to provide the respective compensation current $I_3$. The control unit 84 may be adapted to measure the leakage current $I_L$ in one of the current paths 90, 92 and to provide the compensation current $I_3$ to the same or the other current path 90, 92. The switching devices 106 are preferably formed of semiconductor devices.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A device configured to supply electrical power to a load comprising an LED unit having one or more LEDs, the device comprising:

a connection element for electrically connecting the device to an external power source via a phase-cut dimmer, the power source providing a periodic alternating current (AC) supply voltage, and the phase-cut dimmer having a triac and a timing capacitor for turning on the triac in response to the AC supply voltage, the phase-cut dimmer providing an input voltage for powering the load, a monitoring device for monitoring a leakage current of the load during a first time interval of the periodic AC supply voltage when a triac of the phase-cut dimmer is switched off, the leakage current charging the timing capacitor during the first time interval, and a signal controller connected to the connection element for providing an electrical compensation signal to the connection element during a second time interval of the periodic AC supply voltage when the triac of the phase-cut dimmer is switched off, subsequent to the first time interval, on the basis of the leakage current of the load monitored by the monitoring device during the first time interval, wherein the electrical compensation signal compensates for a charge which is accumulated in the timing capacitor of the phase-cut dimmer during the first time interval due to the leakage current of the load during the first time interval.

2. The device of claim 1, wherein the monitoring device comprises a measuring device for measuring the leakage current or a receiver for receiving a signal corresponding to the leakage current.

3. The device of claim 1, wherein the compensation signal is a charge current exchanged between the phase-cut dimmer and the device to compensate for the leakage current.

4. The device of claim 3, wherein the compensation signal is a voltage provided in series with the load.

5. The device of claim 3, wherein the signal controller comprises an impedance path forming a defined current path for providing the charge current during the second time interval.

6. The device of claim 5, wherein the signal controller comprises a resistor for changing a resistance of the impedance path to control the charge current during the second time interval.

7. The device of claim 6, wherein the signal controller is adapted to decrease the resistance of the impedance path continuously or stepwise during the second time interval.

8. The device of claim 7, wherein a transition from the first time interval to the second time interval is adjusted close to the zero crossing of the supply voltage.

9. The device of claim 8, wherein the signal controller comprises a capacitor for providing the charge current during the second time interval, wherein the monitoring device is adapted to charge the capacitor during the first time interval.

10. The device of claim 6, wherein the second time interval is adjusted to a zero crossing of the supply voltage such that the current path is provided before and after the zero crossing of the supply voltage.

11. The device of claim 1, further comprising:

input terminals for receiving the input voltage from an external power source via the phase-cut dimmer, and output terminals for providing a load current or powering the load.

12. The device of claim 11, further comprising:

a rectifier unit;

a first current path;

a second current path, wherein the first and the second current path form a part of the rectifier unit, wherein the first current path includes the monitoring device and the signal controller, wherein the monitoring device is configured to measure the load current in the first current path, and the signal controller is configured to provide the electrical compensation signal in response to the load current measured in the first current path;

a second monitoring device; and a second signal controller, wherein the second current path includes the second monitoring device and the second signal controller, wherein the second monitoring device is configured to measure the load current in the second current path, and the second signal controller is configured to provide the electrical compensation signal in response to the load current measured in the second current path.

13. The device of claim 1, wherein the electrical compensation signal is a charge current provided to the phase-cut dimmer to at least partially charge or discharge the timing capacitor.

14. The device of claim 1, wherein the first time interval comprises a disconnection phase of the AC input voltage preceding a zero crossing of the AC input voltage, during which the triac of the phase-cut dimmer is off and the load presents to the phase-cut dimmer a first impedance which is greater than an impedance of a timing circuit of the phase-cut dimmer which includes the timing capacitor, and wherein the second time interval comprises an off phase of the AC input voltage subsequent to the zero crossing of the AC input voltage during which the triac of the phase-cut dimmer is off and the load presents to the phase-cut dimmer a second impedance which is less than the first impedance.

15. An electrical device configured to operate in combination with a phase-cut dimmer for compensating an untimely switching effect of a variable electrical load current of a load on the phase-cut dimmer, the phase-cut dimmer having a triac and a timing capacitor for turning on the triac in response to an AC supply voltage, load being an LED unit having one or more LEDs, the electrical device comprising:

a connection element for electrically connecting the electrical device to the phase-cut dimmer of an external power source, the external power source providing a supply voltage and the dimmer providing an input voltage for powering the load, a monitoring device for monitoring a leakage current of the load during a first time interval when the triac of the phase-cut dimmer is switched off, and a signal controller connected to the connection element for providing an electrical compensation signal to the connection element during a second time interval when the triac of the phase-cut dimmer is switched off on the basis of the leakage current of the load monitored by the monitoring device during the first time interval.

16. The electrical device of claim 15, wherein the input voltage is an alternating current (AC) input voltage, wherein the first time interval comprises a disconnection phase of the AC input voltage preceding a zero crossing of the AC input voltage, during which the triac of the phase-cut dimmer is off and the load presents to the phase-cut dimmer a first impedance which is greater than an impedance of a timing circuit of the phase-cut dimmer, and wherein the second time interval comprises an off phase of the AC input voltage subsequent to the zero crossing of the AC input voltage during which the triac of the phase-cut dimmer is off and the load presents to the phase-cut dimmer a second impedance which is less than the first impedance.

17. A method for compensating an untimely switching effect of an variable electrical load current of a load on a phase-cut dimmer, the phase-cut dimmer having a triac and a timing capacitor for turning on the triac in response to an AC supply voltage, the load being an LED unit comprising one or more LEDs, the method comprising:

connecting an electrical device to the phase-cut dimmer of an electrical power supply using a connection element, monitoring a leakage current of the load during a first time interval when the triac of the phase-cut dimmer is switched off, and providing an electrical compensation signal to the connection element during a second time interval when the triac of the phase-cut dimmer is switched off on the basis of the leakage current of the load monitored during the first time interval.

18. The method of claim 17, wherein the electrical compensation signal compensates for a charge accumulated in a timing capacitor of a timing circuit of the phase-cut dimmer during the first time interval due to the leakage current of the load during the first time interval.

19. The method of claim 18, wherein the electrical compensation signal is a charge current provided to the phase-cut dimmer to at least partially charge or discharge the timing capacitor.

20. The method of claim 18, further comprising receiving at the electrical device an alternating current (AC) input voltage from the phase-cut dimmer, wherein the first time interval comprises a disconnection phase of the AC input voltage preceding a zero crossing of the AC input voltage, during which the triac of the phase-cut dimmer is off and the load presents to the phase-cut dimmer a first impedance which is greater than an impedance of the timing circuit, and wherein the second time interval comprises an off phase of the AC input voltage subsequent to the zero crossing of the AC input voltage during which the triac of the phase-cut dimmer is off and the load presents to the phase-cut dimmer a second impedance which is less than the first impedance.

* * * * *